US006259860B1

(12) United States Patent
Chen-Lung et al.

(10) Patent No.: US 6,259,860 B1
(45) Date of Patent: Jul. 10, 2001

(54) HUMIDIFIER

(76) Inventors: Huang Chen-Lung; Huang Chuang-pan, both of 9F3R, No. 210, Chung Hsueh Rd., Tainan City (TW)

( * ) Notice: Subject to any disclaimer, the term of this patent is extended or adjusted under 35 U.S.C. 154(b) by 0 days.

(21) Appl. No.: 09/704,347

(22) Filed: Oct. 30, 2000

(51) Int. Cl.[7] ..... A61H 33/12; H01H 35/18
(52) U.S. Cl. ..... 392/403; 200/840
(58) Field of Search ..... 392/402, 403, 392/404, 405, 406; 261/24, 26, 27, 66, 67, 68, DIG. 65; 200/84 R, 84 C

(56) References Cited

U.S. PATENT DOCUMENTS 4,921,639 * 5/1990 Chiu ..... 261/67
5,037,583 * 8/1991 Hand ..... 261/26
5,156,078 * 10/1992 DeFigueiredo et al. ..... 200/84 C
5,483,616 * 1/1996 Chiu et al. ..... 392/406
5,609,047 * 3/1997 Hellman, Jr. et al. ..... 392/405
5,880,423 * 3/1999 Li ..... 200/84 C

* cited by examiner

*Primary Examiner*—Sang Paik
(74) *Attorney, Agent, or Firm*—Pro-Techtor International Services

(57) ABSTRACT

A humidifier includes a float positioned at a water outlet of a water tank, and a body containing a water level sensor functioning with the float rising and falling with the level of the water in a water chamber in the body to drive the water level sensor in case of the water level falling to the lowest to turn off the humidifier. Then the water tank is simplified in its structure and making the humidifier safe to use.

2 Claims, 5 Drawing Sheets

HUMIDIFIER

BACKGROUND OF THE INVENTION

This invention relates to a humidifier, particularly to one having a body and a water storing tank and a float fitted around a water outlet of the water tank to move up and down together with the level of water in a water chamber of the body so as to drive a water level sensor to turning on and off the humidifier.

A known conventional humidifier shown in FIGS. 1 and 2 includes a water level sensor S disposed in a water-storing tank A, and a float S1 fixed at an outer circumference or one side of the water level sensor S. The float S1 rises up and down together with the level of the water in the water storing tank A, and the water level sensor S is controlled by the float S1 to turn on or off. So when the float S1 falls down to the lowest water level, the water level sensor S may turn off the control electric circuit of the humidifier to prevent a heater or an ultrasonic oscillator from burning and also the humidifier from becoming out of order.

When the water level is normal or in the scope except the lowest level, the float can keep turning on the control electric circuit and subsequently turn on the switch of the humidifier. But provided the humidifier is placed to lie lateral or upside down, the float always stays at the highest water level or in the effective scope to always turn on the control electric circuit, even if there left no water in the water storing tank A or water flows into an upper cap. Then the float S1 may permit the water level sensor S sense wrongly that the water in the water storing tank A has its level in the standard scope to let the switch of the humidifier always turning on. Then the heater of the humidifier may be heated up idle or the ultrasonic oscillator may be burned to cause disorder of the humidifier and danger to a user.

SUMMARY OF THE INVENTION

The objective of the invention is to offer a humidifier having a float formed as integral with a bottom base of a water tank, making the humidifier and a user safe.

The feature of the invention is a float combined with the bottom base of the water tank and near a water outlet of the water tank and separated together with a water level sensor when the water tank is removed from the humidifier. So malfunction of the water level sensor never happens, and in addition, the float is located near the water outlet, easily sensing the lowest water level in the water tank to let the sensor turn off the power of the humidifier to protect it.

BRIEF DESCRIPTION OF DRAWINGS

This invention will be better understood by referring to the accompanying drawings, wherein.

DETAILED DESCRIPTION OF THE PFEFERRED EMBODIMENT

Figure 1:
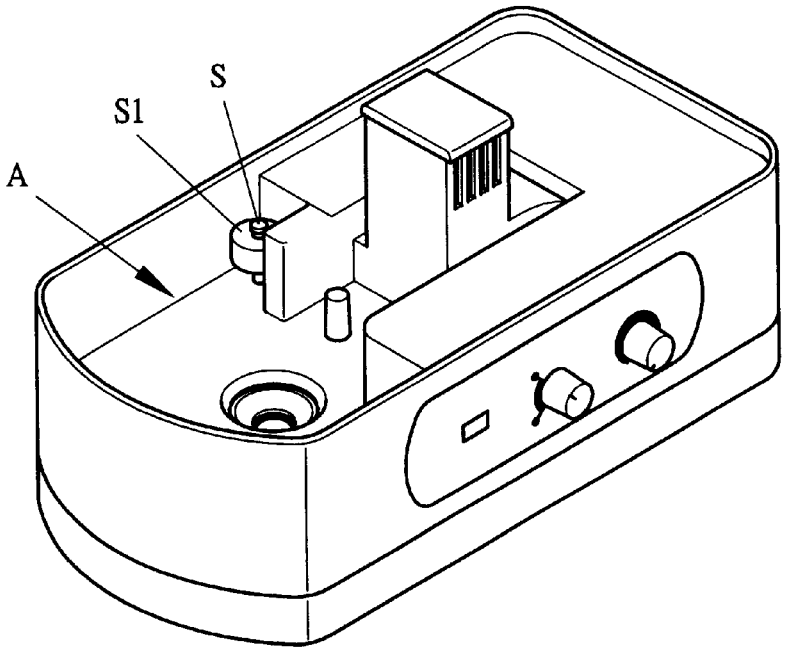
FIG 1 (PRIOR ART)
FIG. 1 is a perspective view of a first known conventional humidifier.
Figure 2:
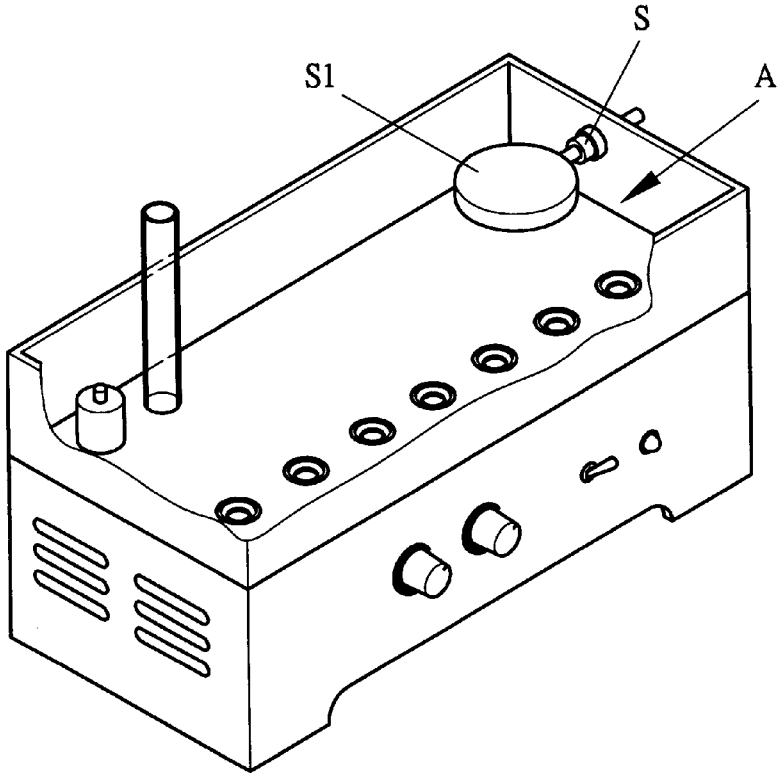
FIG 2 (PRIOR ART)
FIG. 2 is a perspective view of a second known conventional humidifier.
Figure 3:
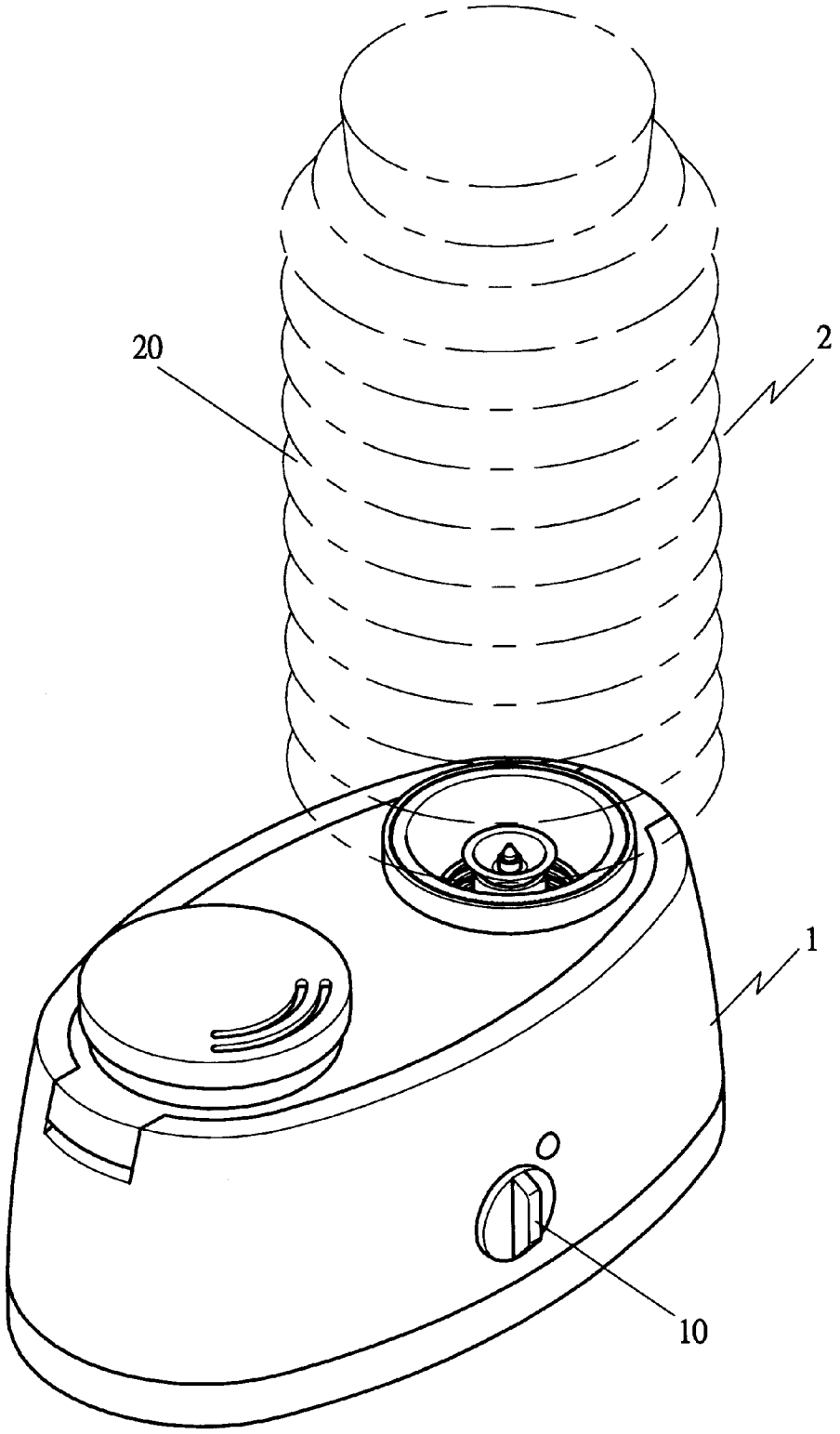
FIG. 3 is a perspective view of a humidifier in the present invention.
Figure 4:
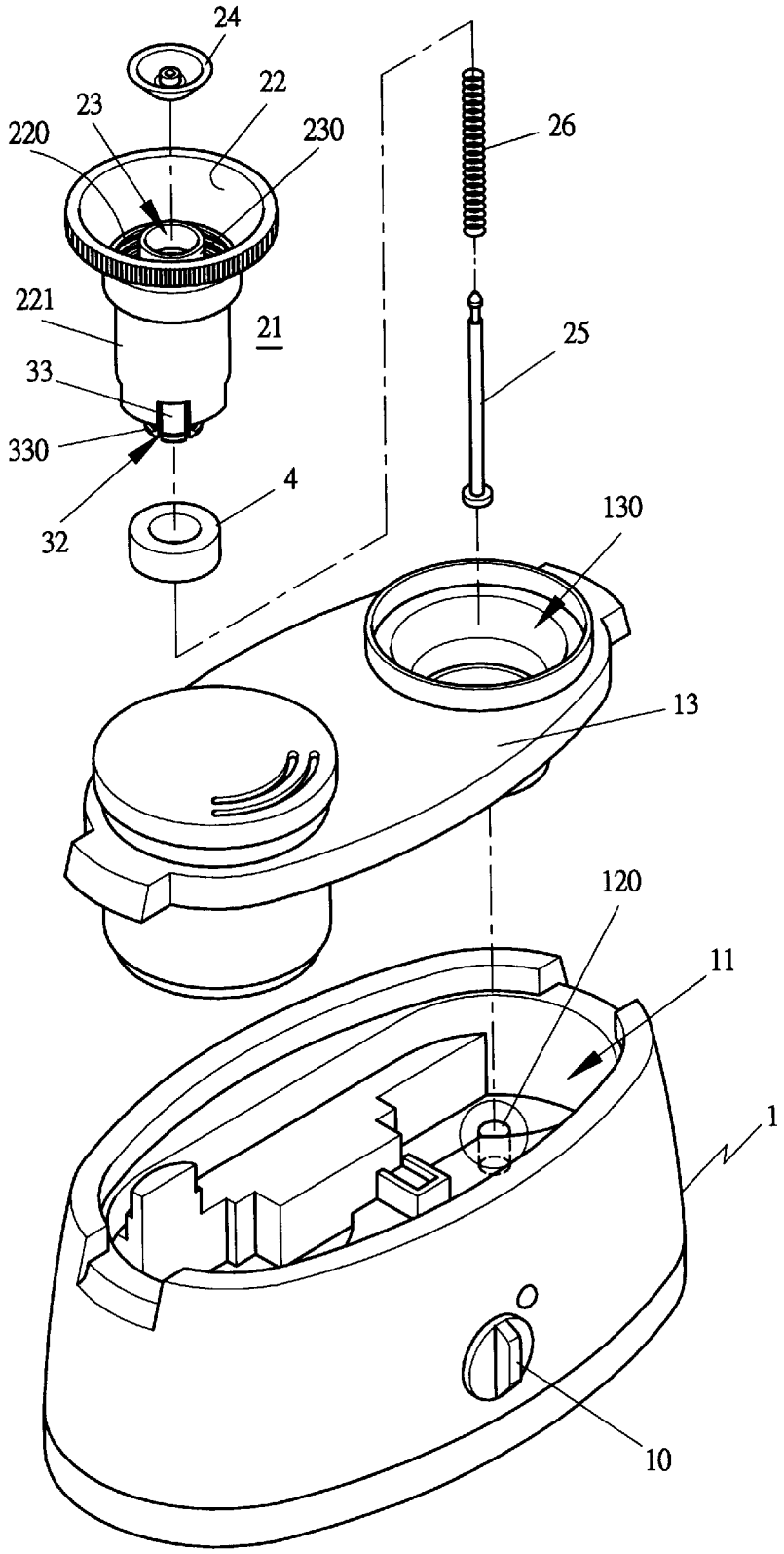
FIG. 4 is an exploded perspective view of the humidifier in the present invention.

A preferred embodiment of a humidifier in the present invention, as shown in FIGS. 3 and 4, includes a body 1 having a switch 10, a water chamber 11 and a water level sensor 12, a water storing tank 2, and a cap 13 as main components combined together.

Figure 5:
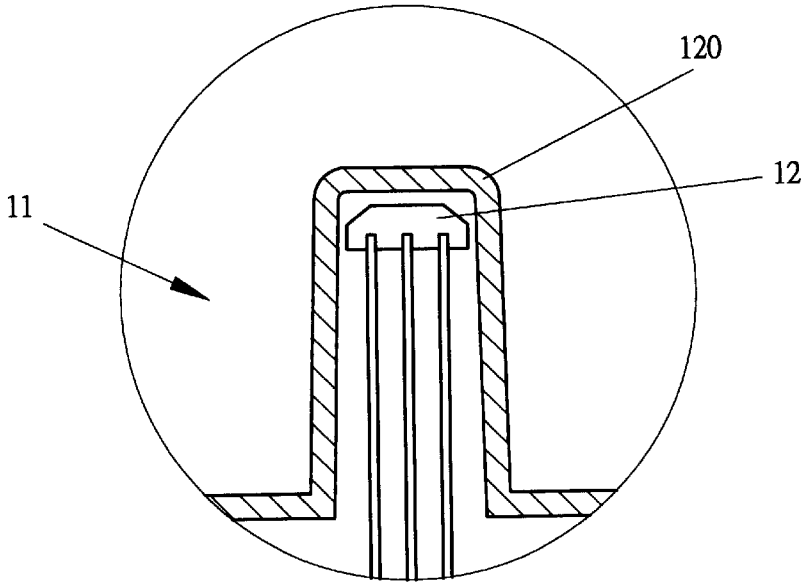
FIG. 5 is a cross-sectional view of a water level sensor in the present invention.
Figure 6:
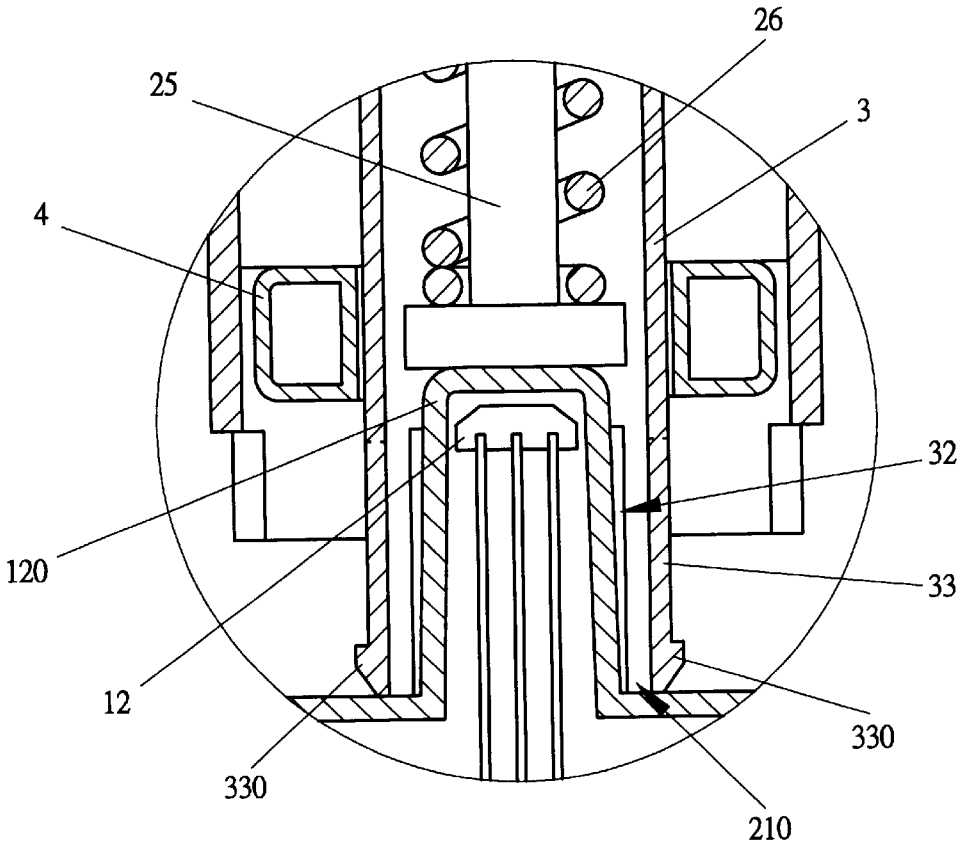
FIG. 6 is a cross-sectional view of the water level sensor and a float operating together in the present invention.

The water level sensor 12 may be an infrared sensor shown in FIGS. 5 and 6, a HALL effect digital switch or a near switch or any element having the same function, normally deposited in the water chamber 11 of the body 1.

The cap 13 has an insert hole 130 formed in one side for receiving the lower portion of the water tank 2.

The water storing tank 2 is a bellows-type tank 20, as shown in FIG. 3, or a common tank such as made of hard plastic, combined with a bottom base 21, which has a conical wall 22 closely fitting a bottom portion of the water tank 2 to prevent water from leaking out, a female threads portion 220 extending down from the conical wall 22 to engage with a male threads portion of the bottom portion of the water tank 2, and an outer cylindrical portion 221 under the conical wall 22 and having the same outer diameter as the inner diameter of the insert hole 130 of the cap 13 so that the bottom base 21 together with the water tank 2 may quickly assembled with or disassembled from the cap 13 and the body 1. Further, the conical wall 22 has a water hole 23 in its bottom and a stopper 24 for closing the water hole 23 in case of stopping water to fall in the body 1.

Further, a connect rod 25 is provided, and a coil spring 26 fitting around the connect rod 25, and the upper end of the connect rod 25 screws with the stopper 24 by means of a nut. An inner cylindrical member 3 is vertically provided in the bottom base 21, located under the water hole 23 and extending down to protrude out of the bottom of the bottom base 21, having plural connect annular walls 30 formed in an upper end and connected to an annular wall of the water hole 23. The plural connect annular walls 30 have plural water gaps 231 for water to fall through into the water chamber 11 of the body 1. A small cylinder 31 is provided in the center of the connect wall 30 for the connect rod to pass through, having an annular spring recess 310 for a receiving a spring 26 to be compressed or resiliently push back the small cylinder 31. The inner cylindrical member 3 has plural grooves 32 formed in a bottom and a hook member 330 formed on an outer bottom end of each divided wall 33 of the cylindrical member 3. Each divided wall 33 has elasticity to expand or shrink back by means of the plural grooves 32. Thus, the annular float 4 can be fitted around the bottom end of the cylindrical member 3, prevented from loosening off by means of the hook members 330.

Figure 7:
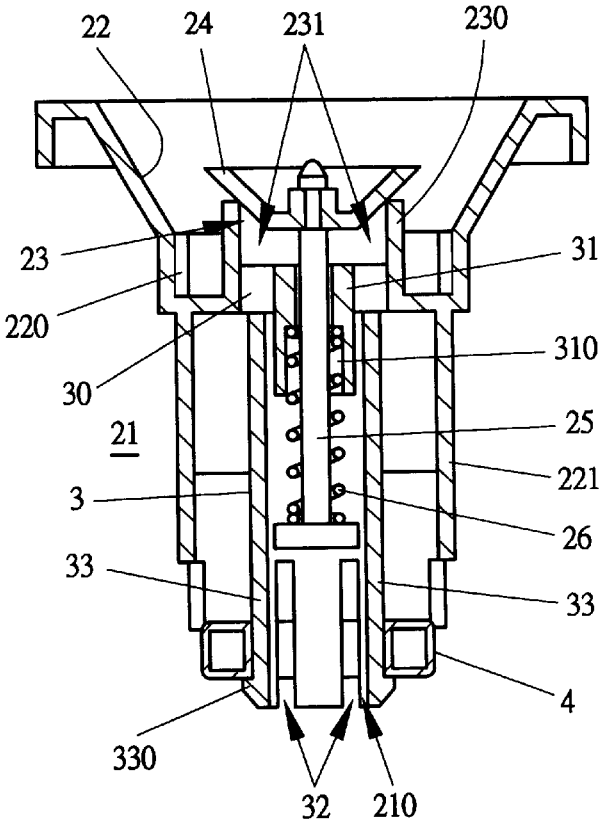
FIG. 7 is a cross-sectional view of a first embodiment of a water tank with a float in the present invention; and, FIG. 8 is a cross-sectional view of the second embodiment of a water tank with a flat in the present invention.
Figure 8:
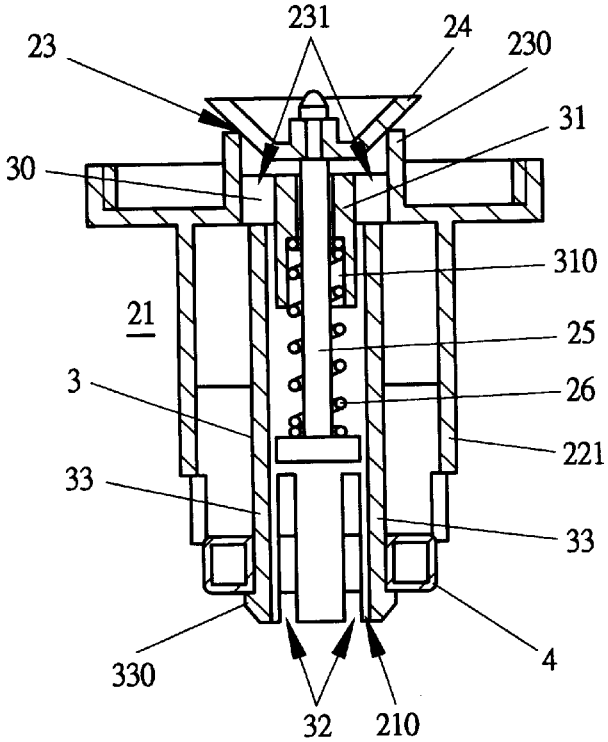

When the water tank 2 is assembled with the body 1, the lower end of the connect rod 25 is pushed up by the bottom base 120 of the water level sensor 12, forcing up the stopper 24 to open the water hole 23, permitting the water in the water tank 2 to flow into the water chamber 11 of the body 1 or to permit the water tank 2 communicate with the body 1. As the annular float 4 fits around the inner cylindrical member 3 as shown in FIGS. 7 and 8, the float 4 moves up and down together with the water level in the water chamber 11, raising up and down accordingly the inner cylindrical member 3 to decide function of the water level sensor 12 to turn or off the humidifier.

The purpose of positioning the float 4 at the bottom of the bottom base 21 and near the water chamber 11 of the body

1 is to acquire the best water level condition in the water chamber 11 in the body 1, improving the disadvantage of the conventional humidifier having a float deposited in the water tank. In addition, even if the humidifier should fall down to lie laterally, malfunction of the water level sensor may not happen to keep safe the humidifier and a user.

While the preferred embodiment of the invention has been described above, it will be recognized and understood that various modifications may be made therein and the appended claims are intended to cover all such modifications that may fall within the spirit and scope of the invention.

What is claimed is:

1. A humidifier comprising a body and a water tank, said body having a water level sensor in its interior, said water tank having a bottom base which has an upper conical wall, a water hole formed in a bottom of said conical wall, a stopper movably closing said water hole, a connect rod vertically fixed in said bottom base and having its upper end firmly fixed with said stopper, a coil spring fitting around said connect rod, said connect rod pushed up by said bottom base of said water lever sensor when said water-storing tank is combined with said body so that said stopper opens said water hole, and characterized by a float fitted around a bottom end of an inner cylindrical member surrounding outside of said connect rod, said float rising and falling together with the water level in said body so as to drive said water level sensor to operate to decide operation of said humidifier.

2. A humidifier comprising a body and a water storing tank, said body having a water level sensor in its interior, said water storing tank combined with a bottom base; said bottom base having a conical wall in an upper portion, a female thread portion extending down from said conical wall to easily screwing with said tater storing tank, an outer cylindrical member having in an outer diameter the same as an inner diameter of an insert hole of said body to easily assemble said bottom base together with said water storing tank with said body, said conical wall having a water hole in a bottom, a stopper provided to close or open said water hole, a connect rod having an upper end firmly fixed with said stopper, a coil spring fitting around said connect rod, an inner cylindrical member provided to extend down from said water hole and having plural connect walls connected to the wall of said water hole, said plural connect walls forming plural gaps for water to fall down, a small cylinder provided to extend down from said connect walls for said connect rod to pass through down; characterized by said inner cylindrical member having plural grooves defined by plural divided walls, said divided walls respectively having a hook formed in its bottom end, said plural grooves permitting said divided walls have some elasticity to expand and shrink so as to permit said float fitted around the bottom end of said inner cylinder member and prevented from loosening off by means of said hooks of said divided walls.

* * * * *